US005875795A

United States Patent [19]

Bouix

[11] Patent Number: 5,875,795

[45] Date of Patent: Mar. 2, 1999

[54] AIRTIGHT CONTAINER

[75] Inventor: Herve F. Bouix, New York, N.Y.

[73] Assignee: Color Access, Inc., Melville, N.Y.

[21] Appl. No.: 956,555

[22] Filed: Oct. 23, 1997

[51] Int. Cl.[6] ..... A45D 33/00

[52] U.S. Cl. ..... 132/293; 132/294; 132/300; 132/315; 206/823

[58] Field of Search ..... 132/293, 294, 132/295, 296, 297, 298, 299, 300, 301, 315; 220/326, 324; 292/83, 254; 206/823, 581

[56] References Cited

U.S. PATENT DOCUMENTS

| | | | |
|---|---|---|---|
| 4,586,519 | 5/1986 | Seidler et al. . | |
| 5,353,818 | 10/1994 | Suzuki et al. | 132/300 |
| 5,542,561 | 8/1996 | Slink et al. | 132/293 |
| 5,682,910 | 11/1997 | Kizawa et al. | 132/293 |
| 5,709,232 | 1/1998 | Scheffler et al. | 132/295 |

FOREIGN PATENT DOCUMENTS

| | | |
|---|---|---|
| 5038243 | 2/1996 | Japan . |
| 8080960 | 3/1996 | Japan . |
| 8080961 | 3/1996 | Japan . |
| 8126524 | 5/1996 | Japan . |
| 8131248 | 5/1996 | Japan . |
| 8140728 | 6/1996 | Japan . |
| 8140729 | 6/1996 | Japan . |
| 8150016 | 6/1996 | Japan . |
| 8154730 | 6/1996 | Japan . |
| 8168411 | 7/1996 | Japan . |
| 8191712 | 7/1996 | Japan . |
| 8191714 | 7/1996 | Japan . |
| 8238123 | 9/1996 | Japan . |
| 8256829 | 10/1996 | Japan . |
| 9037838 | 2/1997 | Japan . |

*Primary Examiner*—Gene Mancene
*Assistant Examiner*—Philogene Pedro
*Attorney, Agent, or Firm*—Kenyon & Kenyon

[57] ABSTRACT

This invention provides an airtight cosmetic container, which comprises a cover, a base, and a hollow gasket positioned on the cover or the base. As the cover is moved into the closed position, the gasket deforms to a point where the gasket sealingly engages the cover and the base. The gasket surrounds a volatile solvent-containing product, and because the gasket deforms between the cover and the base, a seal is obtained which substantially prevents the loss of the volatile solvent from the product when the container is closed.

48 Claims, 7 Drawing Sheets

AIRTIGHT CONTAINER

FIELD OF THE INVENTION

The present invention relates to a cosmetic compact or similar hinged container. More particularly, it concerns an airtight container which prevents the loss of a volatile solvent from the product contained therein by sealing the internal contents from the external environment.

BACKGROUND OF THE INVENTION

It is desirable to have products that contain a volatile solvent because the volatile solvent provides for a better "feel" of the product when applied to the skin. The problem encountered with these types of formulations is that they readily lose the volatile solvent contained within their composition due to evaporation from the product.

The loss of a volatile solvent from a product can adversely affect the physical properties of the product as well as reduce the amount of volatile delivery. Even when not stored above room temperature, it has been noted that there is loss of the volatile solvent over time.

A standard cosmetic compact, which is used to hold non-volatile solvent containing products, is composed of a base and a cover. The base and the cover are attached to each other by a hinge which allows the cover to swing away from the base, thus exposing the product. To keep the cover in contact with the base when the cover is closed, a latch is typically provided. This latch is effective in keeping the cover of the compact closed, but does not provide an airtight seal. This is because the cover and the base of the compact have inherent manufacturing tolerances which do not permit an airtight seal to be made when the cover is in the closed position, thus making a standard compact ineffective for use with a volatile solvent-containing product.

Currently, there are many compacts that provide a seal which prevents the loss of a volatile solvent from a product. These compacts provide for the sealing of the product from the external environment through the use of a screw caps, liners and gaskets, additional covers, and combinations of these elements.

Typical screw cap sealing compacts are such as those disclosed in JP 8256829. With this style of sealing compact, a separate compartment is provided for the product. This compartment has an outer wall which contains a threaded finish. Over this outer wall is placed a cap with a matching internal thread. The cap is then screwed onto the compartment just as a cap is screwed onto a bottle. The inside of the cap can be provided with a deformable liner which will assist in making a seal along the top edge of the compartment wall when the cap is closed. The drawback to this type of sealing compact is that, in order to gain access to the product, the consumer must first open the compact cover and then unscrew the cap. These multiple steps can sometimes be annoying and confusing to a consumer, thus detracting from the consumer acceptance of such a package.

Sealing compacts, such as those of JP 9037838, utilize an elastic packing material to effectuate a seal. This packing material is in the form of a solid o-ring, placed within a groove in the base, in which the o-ring deforms as it is contacted by a protrusion from the cover. When the solid o-ring deforms, it makes a seal around the cover protrusion. This compact style is, however, difficult to seal because it requires the accurate manufacture of the protrusion that contacts the o-ring, the groove within the base, and the o-ring itself. Furthermore, the solid o-ring requires the consumer to exert a greater amount of force when closing the cover. This is because the consumer has to deform a solid structure before the cover can be held in place via the clamping mechanism.

Dual covers have also been used to provide a seal within a compact (see JP 8154730, JP 8140728, and JP 9037838). This configuration requires the consumer to basically open two compartments, first the cover, and then the covering over the product, before application of the cosmetic. This style is labor intensive for the consumer, because she is required to open the cover of the compact and then open the covering of the product to gain access to it. After that, the consumer then has to close the covering of the product so that she can view herself in the mirror located within the first cover while applying the cosmetic.

The use of a liner within the cover, as disclosed in JP 8191712, JP 8168411, JP 8150016, JP 8140729, JP 8140728, JP 8126524, JP 8038243, JP 8238123, JP 8080961, JP 8080960, JP 8131248, and JP 8191714, has also been used to obtain a seal within the compact. The liner within these compacts engages a raised flange surrounding the product compartment so as to ensure a seal. This engagement causes the force required to close the compact to increase, and in turn, requires the use of a more secure locking mechanism which can withstand this added force without releasing its hold.

Friction fit seals have also been used to seal a compact. U.S. Pat. No. 4,586,519, discloses the use of opposing annular rims which engage each other circumferentially when the compact cover is closed. In order to provide a reliable seal for this type of compact, the annular rims must be precisely molded so that they will contact each other along all points. The molding accuracy required for this construction increases the cost of the compact, and if not controlled properly will not result in an effective seal.

This invention provides for an airtight container which prevents the loss of a volatile solvent from the product.

This invention also provides for an airtight container which does not require additional steps or a significant degree of force to open and close the cover.

Also, this invention provides for an airtight container which has few parts and is simple to assemble.

This invention also provides for an airtight container which is a relatively simple device that avoids interference with the package aesthetics.

SUMMARY OF THE INVENTION

This invention provides an airtight cosmetic container, which comprises a cover, a base, and a hollow gasket positioned on the cover or the base. As the cover is moved into the closed position, the gasket deforms to a point where the gasket sealingly engages the cover and the base. The gasket surrounds a volatile solvent-containing product, and because the gasket deforms between the cover and the base, a seal is obtained which substantially prevents the loss of the volatile solvent from the product when the container is closed. In a preferred embodiment, the hollow gasket is in fluid contact with one or more reservoirs, which are depressed upon closing of the container, thereby inflating the gasket and making a seal between the cover and the base.

BRIEF DESCRIPTION OF THE DRAWINGS

Further objects and features of the present invention will be understood better in light of the embodiment examples which are discussed below with the aid of a drawing wherein.

DETAILED DESCRIPTION OF THE INVENTION

Figure 1A:
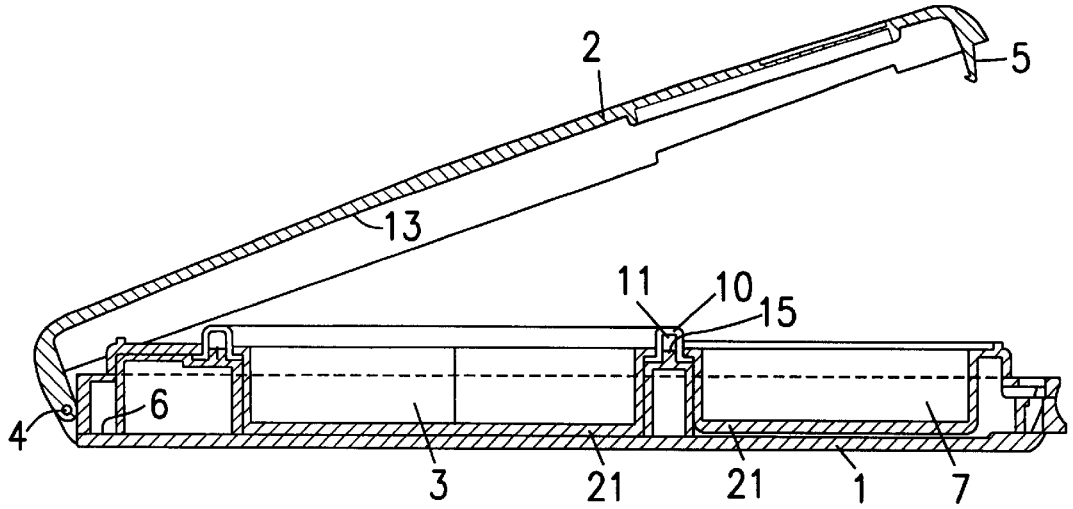
FIGS. 1A and 1B are cross-sectional views of a container in the open and closed positions with a hollow gasket in accordance with one embodiment of the present invention.
Figure 1B:
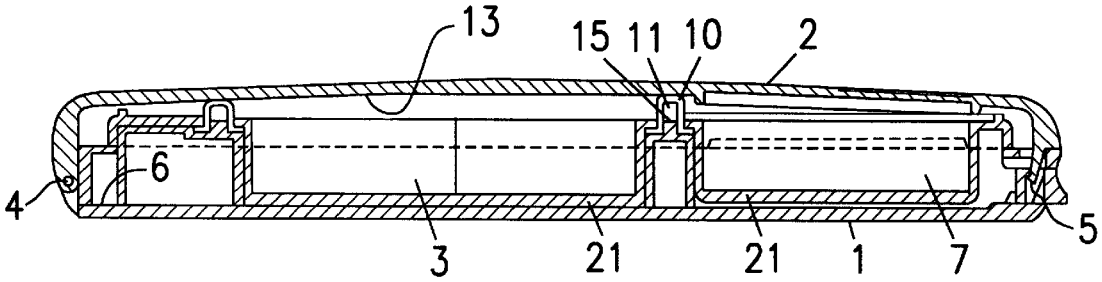

FIGS. 1A and 1B show one embodiment of the airtight container of the present invention. The container includes a base 1 having an internal surface 6 and a compartment 3 for a product. Attached to base 1 is a cover 2. Cover 2 has an internal surface 13 and is attached to base 1 by a means which will allow cover 2 to assume an open position and a closed position. For example, the cover can be pivotally attached to the base, e.g., via a hinge 4, as seen in FIGS. 1A and 1B, wherein the hinge will allow the cover to pivot between an open and a closed position.

The airtight container is further provided with a suitable means 5 for keeping cover 2 in engagement with base 1 when the cover is in the closed position. The means 5 for engaging the cover with the base can be a suitable latch assembly, a push-button assembly, a friction fit assembly, a magnetic assembly, a snap-fit assembly, or any other suitable means. FIG. 1B shows cover 2 held in the closed position in engagement with base 1 by the use of a suitable latch assembly 5.

The cover 2 and the base 1 can be constructed of acrylonitrile-butadienestyrene (ABS), styrene-acrylonitrile (SAN), polypropylene, polyethylene, polycarbonate, polystyrene, polyethylene terephthalate (PET), polyvinylchloride (PVC), acrylic, or any other suitable plastic material. In addition to plastic, the cover and the base can be constructed of metal or metal alloys such as aluminum, gold, silver, brass, and the like.

A hollow gasket 10 having an internal channel 11 is positioned on either the internal surface 13 of the cover 2 or the internal surface 6 of the base 1. The contents of internal channel 11 can be filled with a liquid, such as oil or water, or a gas, such as nitrogen, carbon dioxide, or oxygen. Preferably, internal channel 11 is filled with air.

Figure 4:
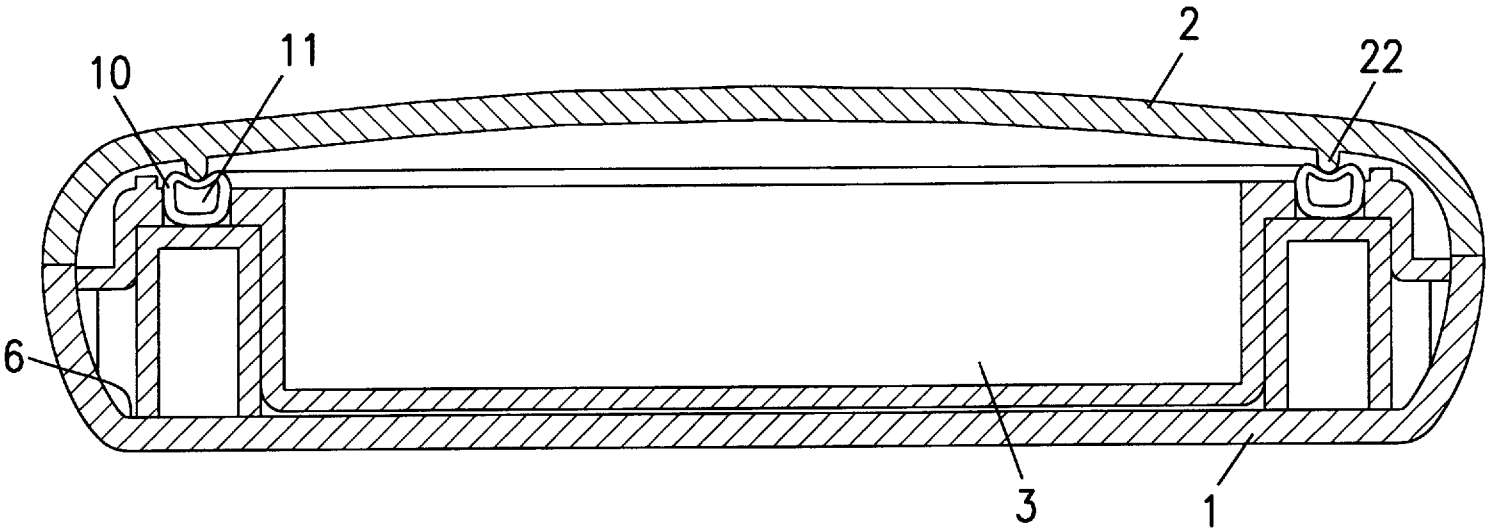
FIG. 4 is a cross-sectional view illustrating one embodiment the gasket of the present invention.
Figure 5:
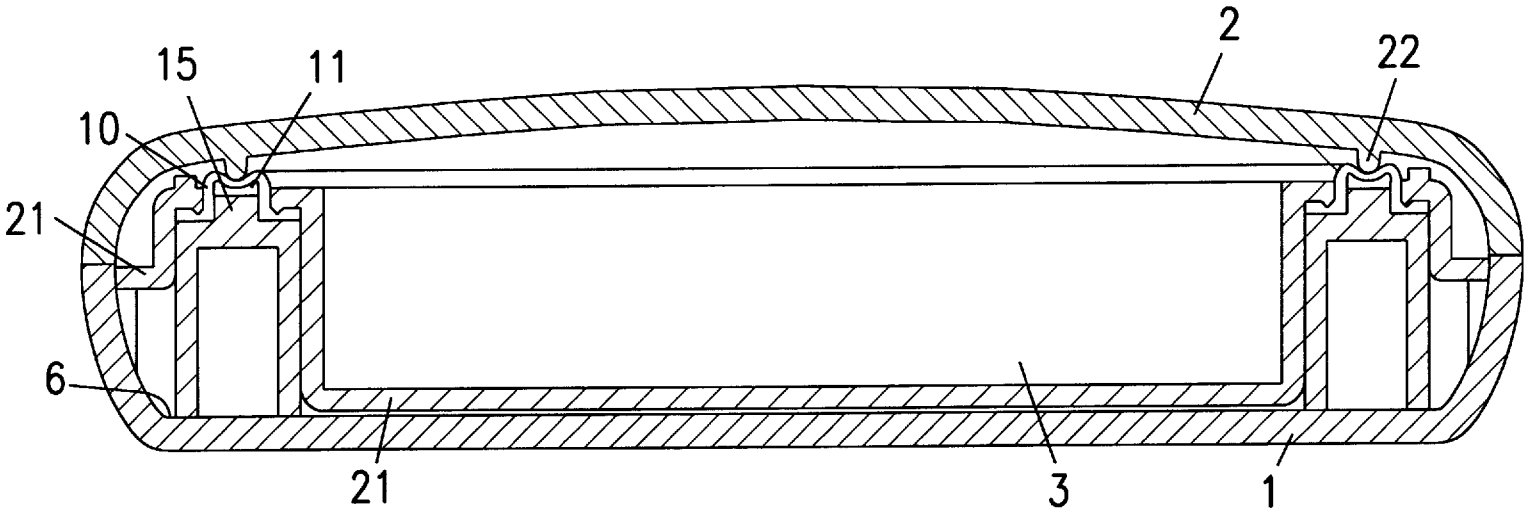
FIG. 5 is a cross-sectional view illustrating a further embodiment the gasket of the present invention.
Figure 6B:
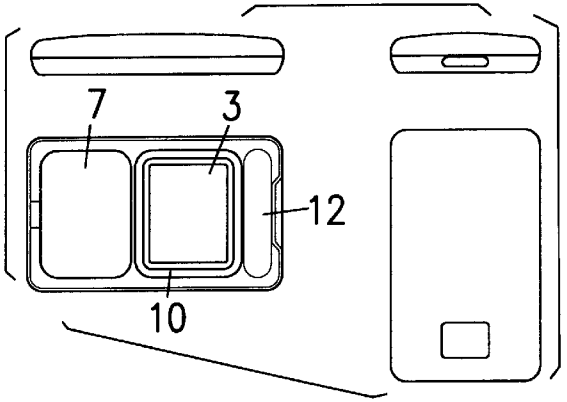
FIGS. 6A through 6H show various shapes of the gasket and according to the present invention.
Figure 6D:
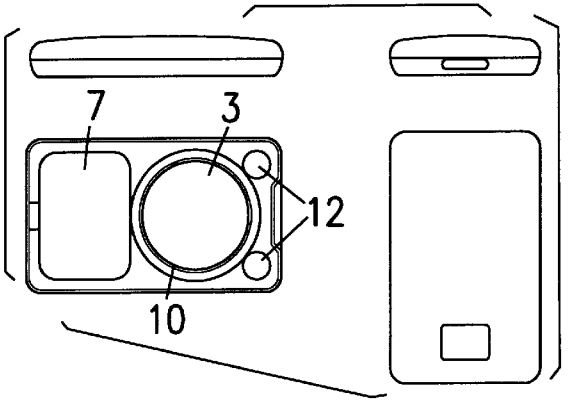
Figure 6A:
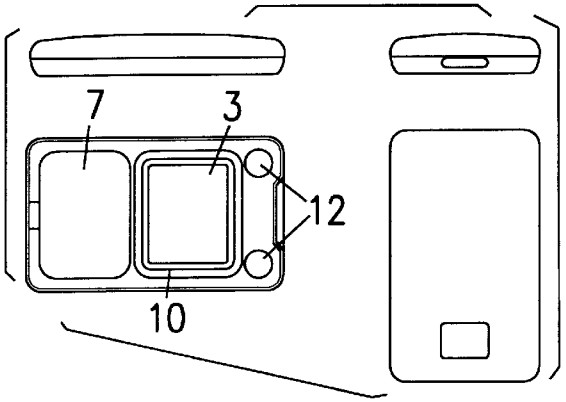
Figure 6C:
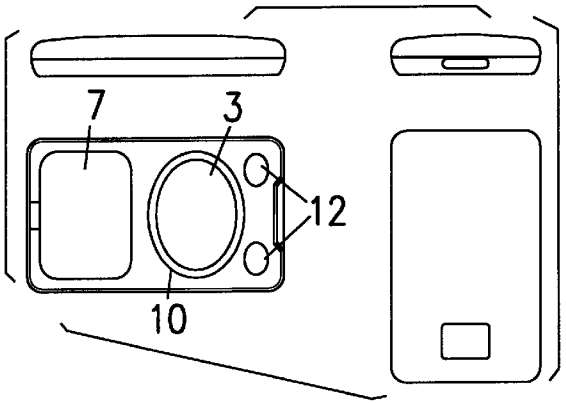
Figure 6F:
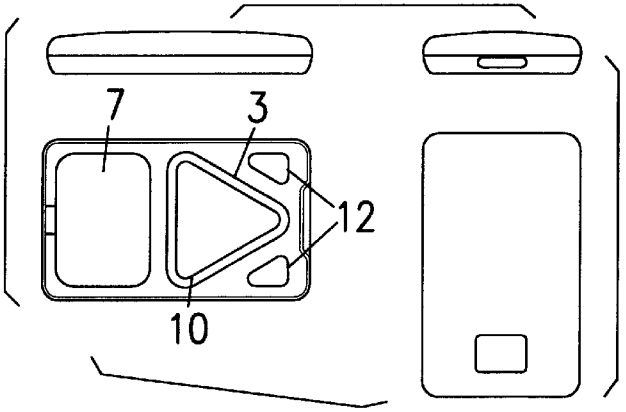
Figure 6E:
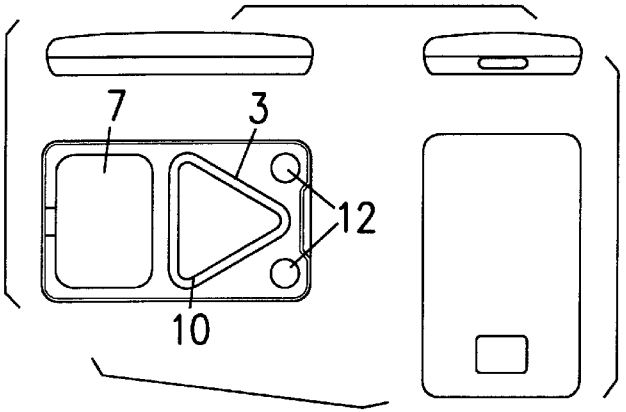
Figure 6H:
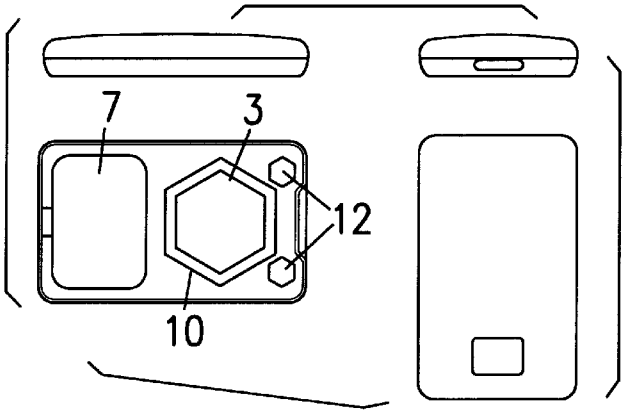
Figure 6G:
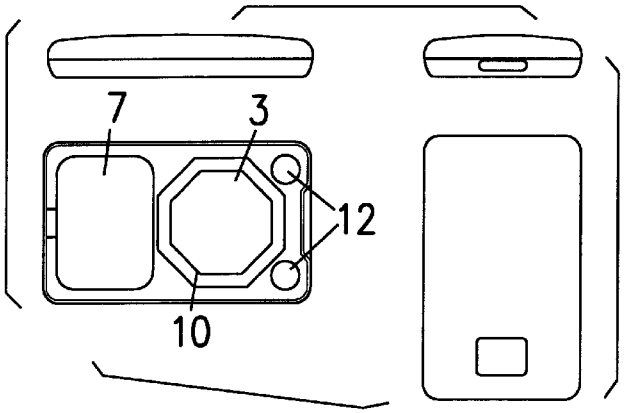

In order to maintain an internal channel 11 within gasket 10, gasket 10 can be formed as a ring-shaped member having a hollow center (as seen in FIG. 4). Also, as shown in FIG. 5, gasket 10 can be formed as a "C", "U", or similarly shaped member having an open edge, and then positioned on the cover or the base so as to seal the open edge and form internal channel 11.

When gasket 10 is formed as a "C", "U", or similarly shaped member, the open edge can be sealed through the use of an insert 21. Insert 21 is dimensioned so as to effectively seal the contents of internal channel 11 . To further assist in the sealing of the open edge of gasket 10, a rim 15 can be provided (see FIGS. 1A, 1B, 2A, 2B, and 5). Rim 15 can be located on the internal surface 6 of the base 1, as seen in FIG. 5, or on the internal surface 13 of cover 2 (not shown).

In alternate embodiments, gasket 10 can be positioned on the internal surface of cover 2 or base 1 through the use of a suitable adhesive, or by dimensioning gasket 10 to fit within a similarly dimensioned groove on the internal surface of base 1 or cover 2, or by a secondary molding process whereby gasket 10 is injection molded onto the internal surface of cover 2 or base 1, or by any other means suitable for positioning a gasket on the internal surface of the cover 2 or base 1.

Gasket 10 is composed of an elastomeric material which will allow gasket 10 to deform easily as the cover of the container comes into contact with the gasket. Suitable gasket materials are natural rubbers, synthetic rubbers, or a combination of natural and synthetic rubbers, such as butyl rubber, latex, silicone, neoprene, isoprene, nitrile rubber, buna rubber, and the like.

Operation of the present invention is simple: as an example in which the gasket is positioned on the internal surface of the base, when the cover 2 of the container of FIGS. 1A and 1B is pivoted into the closed position, the internal surface 13 of cover 2 comes into contact with gasket 10. The contacting of internal surface 13 with the gasket 10 causes the gasket to deform. The internal surface 13 of cover 2 is dimensioned so as to deform gasket 10 to a point where a seal between cover 2 and base 1 is obtained, as shown in FIG. 1B. The action is simply reversed when the gasket is positioned on the cover: When the cover closes, the internal surface of the base contacts the gasket, causing it to deform.

The use of a hollow gasket instead of a solid gasket eliminates the need for an extra piece, e.g., a disk, within the compact to compensate for the high tolerances associated with the manufacture and assembly of a hinged compact. For example, when the cover and the base of a compact are molded, the internal surfaces of the cover and the base, generally, are not given the most exacting tolerances because they do not serve a function within the entire design of the compact, and if required to be exacting in dimension, will increase the cost of the compact considerably. Therefore, when a solid gasket is placed within the compact to form a seal, either the internal surfaces of the cover and the base have to be of exacting tolerances, or an additional piece has to be added for the solid gasket to seal upon. In contrast, a hollow gasket, such as one contemplated for use with the present invention, is able to deform in such a manner as to compensate for the irregularities within the internal surfaces of a molded compact, and make an effective seal without the increased cost of precision molding, or the use of an additional component.

In a preferred embodiment, gasket 10 has an internal channel 11 and one or more reservoirs 12 (see FIGS. 2A, 2B, 3A, 3B, and 6A through 6H). Reservoirs 12 and internal channel 11 are in fluid communication with each other and sealed so as not to allow the contents of reservoirs 12 and internal channel 11 to be accessed. When cover 2 is closed, the internal surface 13 of cover 2 operates to depress reservoir 12. This depressing of reservoir 12 causes the reservoir to disperse its contents into internal channel 11, thus causing gasket 10 to expand. With this embodiment, the internal surface 13 of cover 2 is dimensioned so as to displace a sufficient amount of the contents of reservoir 12 so that gasket 10 expands to a point where a seal between cover 2 and base 1 is obtained. For example, the internal surface 13 can be dimensioned to have raised portions located opposite reservoirs 12 which form actuators that aid in the depressing of reservoir 12. In the same manner, if the gasket 10 was attached to the cover of the container, internal surface 6 of the base 1 would act to depress reservoir 12.

While the container and gasket illustrated are of a certain shape, it will be understood by those skilled in the art that the shape and size of the container and gasket can be varied. For example, the container can be round while the gasket has a generally oval shape, or the container can be rectangular while the gasket has a generally round shape. In a preferred embodiment, gasket 10 is shaped substantially similar to product compartment 3. In a most preferred embodiment, gasket 10 defines product compartment 3. FIGS. 6A through 6H depict some of the possible variations that are within the scope and spirit of the present invention.

Figure 2A:
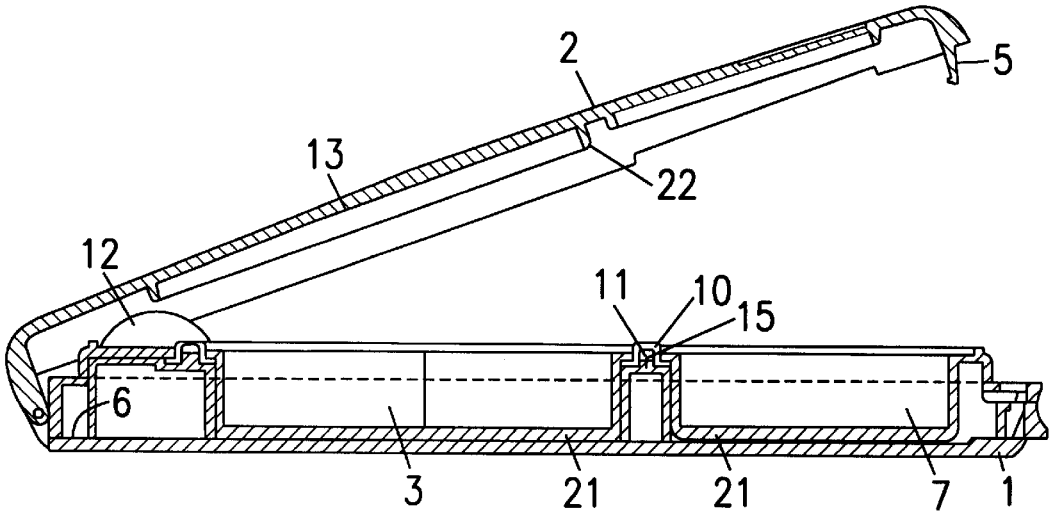
FIGS. 2A and 2B are cross-sectional views of a container in the open and closed positions with a hollow gasket in accordance with a further embodiment of the present invention.
Figure 2B:
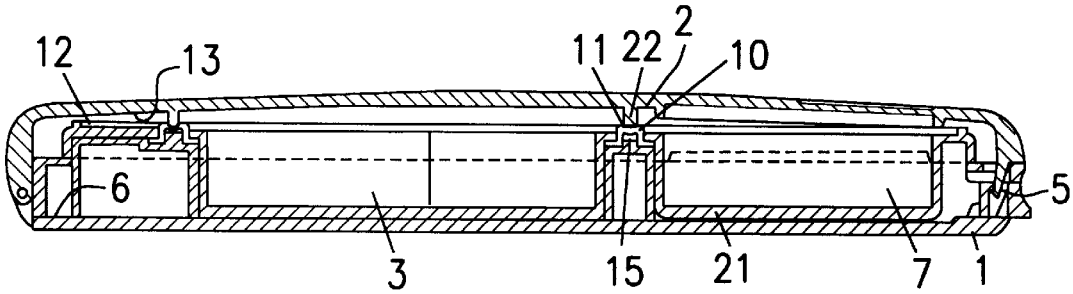
Figure 3B:
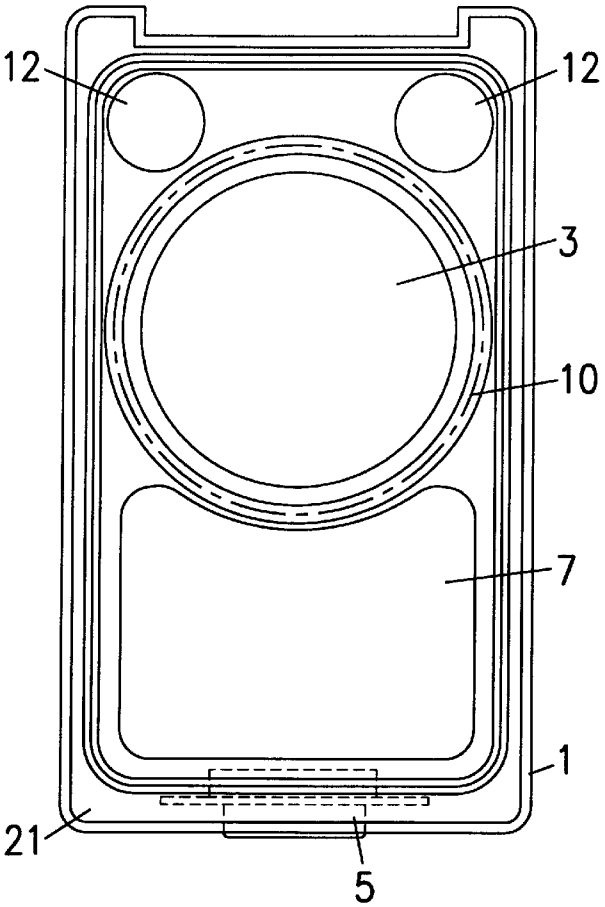
FIG. 3B is a top view of the base of a container having a gasket with two reservoirs, the outline of which is indicated by the dotted line.
Figure 3A:
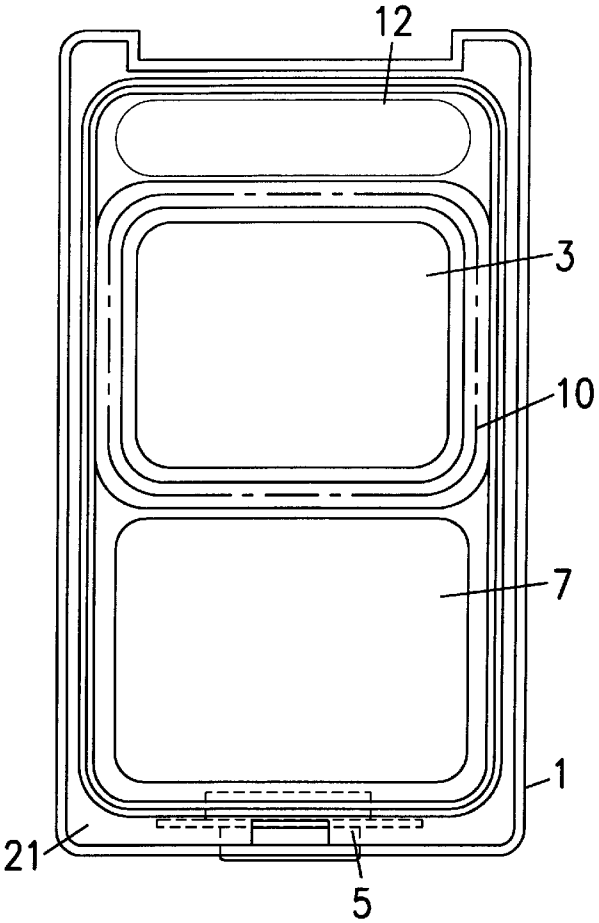
FIG. 3A is a top view of the base of a container having a gasket with one reservoir, the outline of which is indicated by the dotted line.

In one embodiment, as shown in FIGS. 2A and 2B, gasket 10 is sealingly attached to base 1 along a rim 15 which protrudes upwardly from internal surface 6 of base 1. Gasket 10 thereby defines the product compartment 3. Reservoir 12 is attached to gasket 10 along the outer edge of gasket 10 and sealed to internal surface 6 of the container. As cover 2 of the container is closed, the internal surface 13 of cover 2 engages and depresses reservoir 12, thereby causing gasket 10 to expand and contact cover 2.

In addition, a lip 22 can be placed opposite gasket 10 to provide a tighter seal between gasket 10 and the container. See FIGS. 2A, 2B, 4 and 5. Lip 22 is shaped so as to mirror the shape of gasket 10. This will ensure that gasket 10 will contact lip 22 along all points, thus making a seal. For example, when gasket 10 is attached to the base of the container, lip 22 is formed so as to depend from the cover, and is located directly opposite gasket 10.

Lip 22 can be formed as an integral part of the container cover or base, depending on the location of the gasket, or can be provided as an insert within the cover or base.

Also, the container of the present invention can have one or more additional compartments 7 for the housing of product applicators, as seen in FIGS. 1A, 1B, 2A, 2B, 3A, 3B, and 6A through 6H. The applicator stored within compartment 7 will depend on the product being housed by the container, and can include such applicators as puffs, sponges, brushes, eyeshadow applicators, or the like.

This case will be useful in preventing loss of a volatile solvent (i.e., water, oil, or alcohol) from volatile solvent-containing products such as lip balms, lip gloss, solid perfumes, pressed powders, concealers, make-up foundations, eyeshadows, blushes, acne treatment products, sunscreens, and the like.

The invention, and its broader aspects, is not limited to the specific details shown and described; rather, various modifications will be suggested to one skilled in the art, all of which are within the scope and spirit of this invention.

What is claimed is:

1. An airtight cosmetic container capable of an open or a closed position, which comprises:

a base having a first internal surface;

a cover having a second internal surface; and a hollow gasket positioned on one of the first or second internal surfaces.

2. A container as in claim 1, wherein the base has a cosmetic product compartment.

3. A container as in claim 2, wherein the gasket is substantially identical in shape to the product compartment.

4. A container as in claim 3, wherein the gasket defines the product compartment.

5. A container as in claim 2, wherein a cosmetic product is placed within the product compartment.

6. A container as in claim 1, wherein the container is provided with a means for keeping the cover in engagement with the base when the container is in the closed position.

7. A container as in claim 1, wherein the cover is pivotally attached to the base.

8. A container as in claim 1, wherein the gasket makes a seal between the cover and the base when the container is in the closed position.

9. A container as in claim 1, wherein the gasket is composed of an elastomeric material.

10. A container as in claim 9, wherein the gasket is composed of a material selected from the group consisting of natural rubber, synthetic rubber, and a blend of natural and synthetic rubber.

11. A container as in claim 1, wherein the gasket is attached to the internal surface of the base.

12. A container as in claim 1, wherein the gasket is attached to a rim on the internal surface of the base.

13. A container as in claim 1, wherein the gasket is attached to the internal surface of the cover.

14. A container as in claim 1, wherein the gasket is attached to a rim on the internal surface of the cover.

15. A container as in claim 1, wherein a lip is placed on the internal surface opposite the gasket.

16. An airtight cosmetic container capable of an open or closed position, which comprises:

a base having a first internal surface;

a cover having a second internal surface;

an inflatable gasket positioned on one of the first or second internal surfaces; and a reservoir in fluid contact with the gasket.

17. A container as in claim 16, wherein the base has a cosmetic product compartment.

18. A container as in claim 17, wherein the gasket is substantially identical in shape to the product compartment.

19. A container as in claim 18, wherein the gasket defines the product compartment.

20. A container as in claim 16, wherein a cosmetic product is placed within the product compartment.

21. A container as in claim 16, wherein the container is provided with a means for keeping the cover in engagement with the base when the container is in the closed position.

22. A container as in claim 16, wherein the cover is pivotally attached to the base.

23. A container as in claim 16, wherein the gasket makes a seal between the cover and the base when the container is in the closed position.

24. A container as in claim 16, wherein the reservoir is depressed when the container is closed.

25. A container as in claim 24, wherein the reservoir is depressed by the first internal surface when the container is closed.

26. A container as in claim 25, wherein the first internal surface has an actuator located opposite the reservoir.

27. A container as in claim 24, wherein the reservoir is depressed by the second internal surface when the container is closed.

28. A container as in claim 27, wherein the second internal surface has an actuator located opposite the reservoir.

29. A container as in claim 16, wherein the gasket is composed of an elastomeric material.

30. A container as in claim 29, wherein the gasket is composed of a material selected from the group consisting of natural rubber, synthetic rubber, and a blend of natural and synthetic rubber.

31. A container as in claim 16, wherein the gasket is attached to the internal surface of the base.

32. A container as in claim 16, wherein the gasket is attached to a rim on the internal surface of the base.

33. A container as in claim 16, wherein the gasket is attached to the internal surface of the cover.

34. A container as in claim 16, wherein the gasket is attached to a rim on the internal surface of the cover.

35. A container as in claim 16, wherein a lip is placed on the internal surface opposite the gasket.

36. An airtight cosmetic container capable of an open or a closed position, which comprises:

a base having a first internal surface;

a cover having a second internal surface;

an inflatable gasket positioned on one of the first or second internal surfaces, the gasket defining a cosmetic product compartment; and a reservoir in fluid contact with the gasket; wherein, when the container is closed, the reservoir is depressed by an internal surface of the container, inflating the gasket to make a seal between the cover and the base.

37. A container as in claim 36, wherein a cosmetic product is placed within the product compartment.

38. A container as in claim 36, wherein the container is provided with a means for keeping the cover in engagement with the base when the container is in the closed position.

39. A container as in claim 36, wherein the cover is pivotally attached to the base.

40. A container as in claim 36, wherein the first internal surface has an actuator located opposite the reservoir.

41. A container as in claim 36, wherein the second internal surface has an actuator located opposite the reservoir.

42. A container as in claim 36, wherein the gasket is composed of an elastomeric material.

43. A container as in claim 42, wherein the gasket is composed of a material selected from the group consisting of natural rubber, synthetic rubber, and a blend of natural and synthetic rubber.

44. A container as in claim 36, wherein the gasket is attached to the internal surface of the base.

45. A container as in claim 36, wherein the gasket is attached to a rim on the internal surface of the base.

46. A container as in claim 36, wherein the gasket is attached to the internal surface of the cover.

47. A container as in claim 36, wherein the gasket is attached to a rim on the internal surface of the cover.

48. A container as in claim 36, wherein a lip is placed on the internal surface opposite the gasket.

* * * * *